US005137330A

United States Patent [19]

Lie et al.

[11] Patent Number: 5,137,330

[45] Date of Patent: Aug. 11, 1992

[54] ADJUSTABLE CHAIR

[75] Inventors: Tore Lie, Moelv; Steinar L. Flo, Oslo; Per Lundstein, Nylendet, all of Norway

[73] Assignee: Ring Mekanikk a.s., Moelv, Norway

[21] Appl. No.: 483,328

[22] Filed: Feb. 20, 1990

Related U.S. Application Data

[63] Continuation-in-part of Ser. No. 281,852, Dec. 8, 1988, abandoned.

[30] Foreign Application Priority Data

Dec. 8, 1987 [NO] Norway ..... 875106

[51] Int. Cl.[5] ..... A47C 1/02

[52] U.S. Cl. ..... 297/329; 297/327

[58] Field of Search ..... 297/329, 327, 330, 328; 248/393, 394, 395

[56] References Cited

U.S. PATENT DOCUMENTS

| | | | |
|---|---|---|---|
| 2,153,763 | 4/1939 | Kuhler | 297/329 |
| 2,313,023 | 3/1943 | Ruegger | 297/329 |
| 3,299,886 | 1/1967 | Mikan | 297/329 X |
| 4,383,714 | 5/1983 | Ishida | 297/327 X |
| 4,678,231 | 7/1987 | Chizek | 297/329 |

FOREIGN PATENT DOCUMENTS

| | | | |
|---|---|---|---|
| 502781 | 4/1976 | U.S.S.R. | 297/329 |

*Primary Examiner*—Peter A. Aschenbrenner

*Attorney, Agent, or Firm*—Kane, Dalsimer, Sullivan, Kurucz, Levy, Eisele and Richard

[57] ABSTRACT

Adjustable chair, whereby the seat of the chair comprising on each side a rail (10) secured to a front portion under the seat (3) and resting on a roller (11) connected with the chair frame, the seat being, in the rear portion on each side, connected turnably with a guide (5) secured to the frame where the guide having slideably arranged a first glider (6), the back (4) comprising a downwards and forwards directed prolongation and being turnably connected with the first glider (6), the front end of the prolongation being turnably connected with a second glider (8) being slideably arranged on a second guide (7), the second guide thereby being connected with the frame, and first and second guides (5, 7) being arranged in an obtuse angle in relation to each other such that the distance between the rear portion of seat and the lower portion of the back substantially is maintained whereas the angle between the seat and the back is altered when the back is moved backwards by the user in such a way that the gliders (5, 7) and the seat (3) are displaced forwards.

3 Claims, 2 Drawing Sheets

ADJUSTABLE CHAIR

RELATED APPLICATIONS

Figure 2:
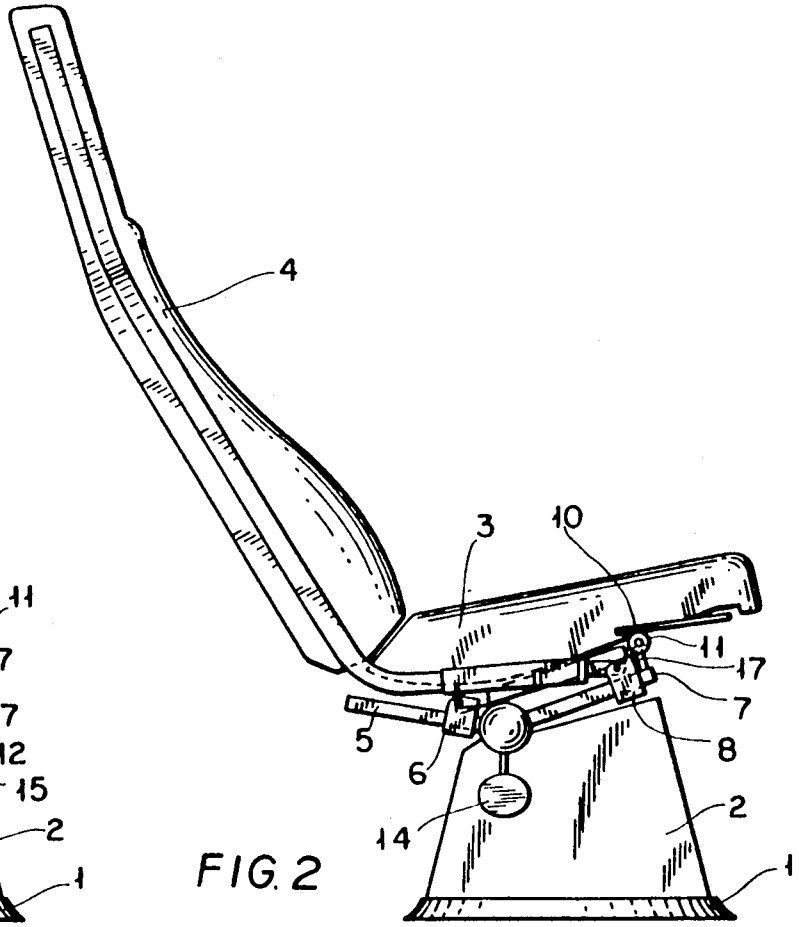

This application is a continuation-in-part to application Ser. No. 281,852 filed Dec. 8, 1988, now abandoned.

The present application is related to a chair having an adjustable back.

Several different designs of chairs are known where the back may be adjusted backward from a substantially upright position, the user thereby having the possibility to assume a rather relaxed position. By some of these chair designs the back is rigid connected with the seat in such a way that the front edge of the seat is tilted when the back is leant backwards. By such a design the angle between the user's thigh and back is maintained. Due to the lifting of the front edge of the seat, however, a comfortable sitting position is not achieved.

In other chair designs the seat is fixed and only the back is adjustable. By such designs the user's cloths will necessarily be deplaced, what is commonly known, for example in that a blouse or a skirt is pulled out of skirt or trousers. The reason for this is that the back of the user will be displaced in relation to the back of the chair without any possibility for the clothes to performe the same movements.

By known designs where both back and seat are adjusted, also in relation to each other, when the back is leant backwards, likewise a relative movement between the user's back and the back of the chair is performed, even if the extend of the movement is less than by a fixed seat. Additionally to the distaste by having the cloths displaced in relation to the body, also the anatomic shape of the back which as a rule is adjusted to the back of the body in upright position, is displaced in such a way that this design does not suit the user's back when the chair back is leant backwards. Normally this is connected with the fact that the angle between the back and the seat is increasing when the back is leant backwards and it thereby occures a larger distance between the rear portion of the seat and the lower portion of the back.

With the chair according o the present invention the above mentioned disadvantages are avoided in such a way that the back portion of the user, both in the upright position of the chair and in the backward position, will lean against the same portion of the chair back and the distance between the rear portion of the seat and the lower portion of the back substantially is maintained during this movement. When the chair back is pressed backwards by the user, the back and seat of the chair will provide movements which substantially follow the thighs and back of the user when the user is leaning backwards. In this way the user may assume an anatomic correct and comfortable position in the upright position of the chair as well as in the backwards tilted position.

The above mentioned advantages are achieved with a chair according to the invention as defined by the features stated in the characterizing clauses of the claims.

In the drawing

Figure 1:
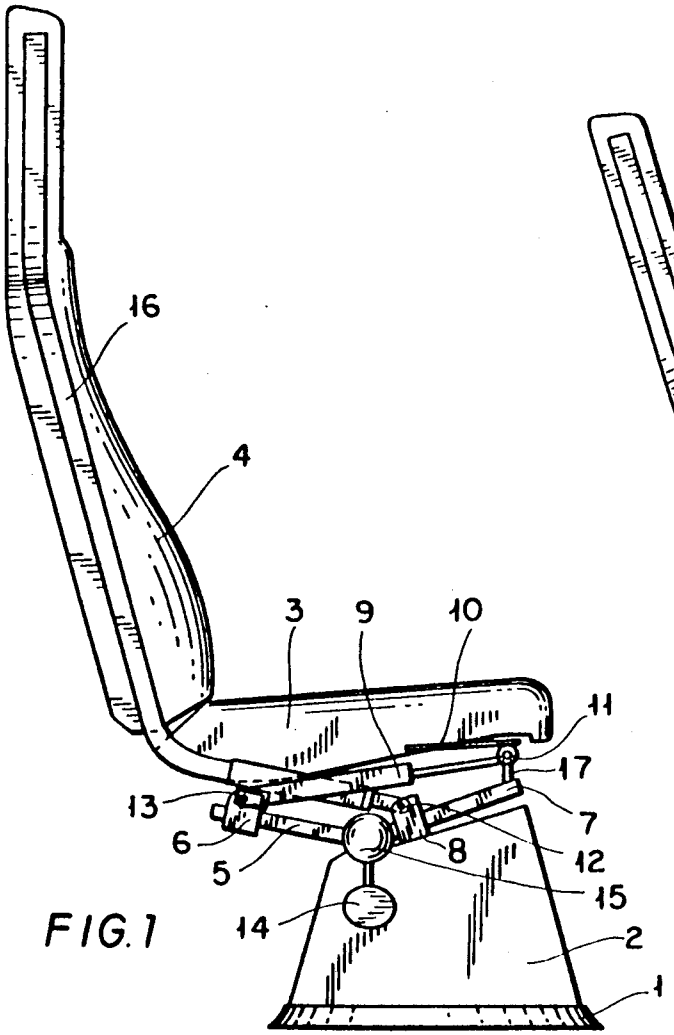
Figure 4:
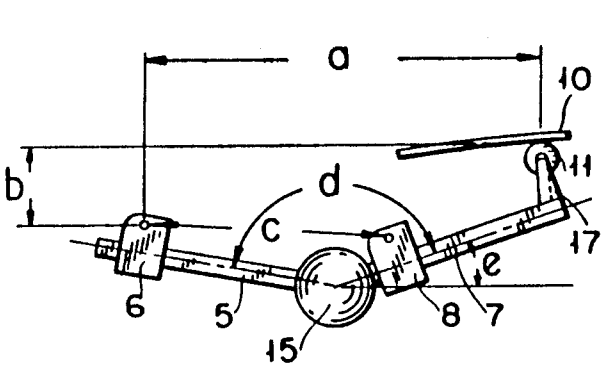
Figure 3:
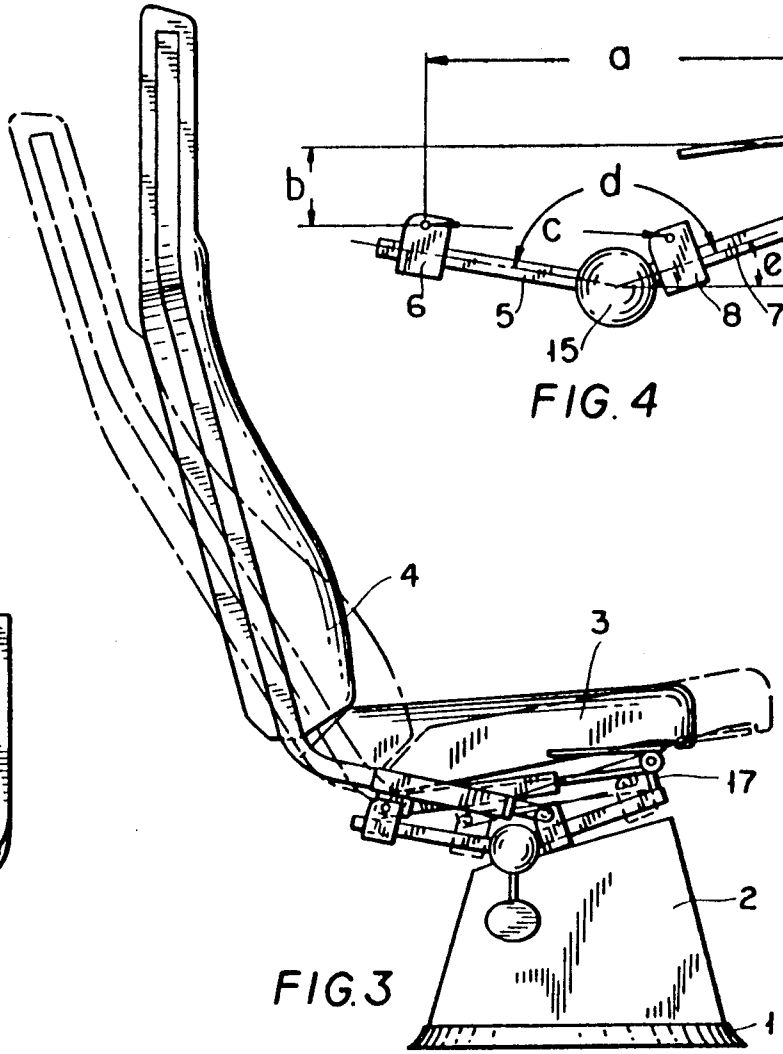
Figure 5:
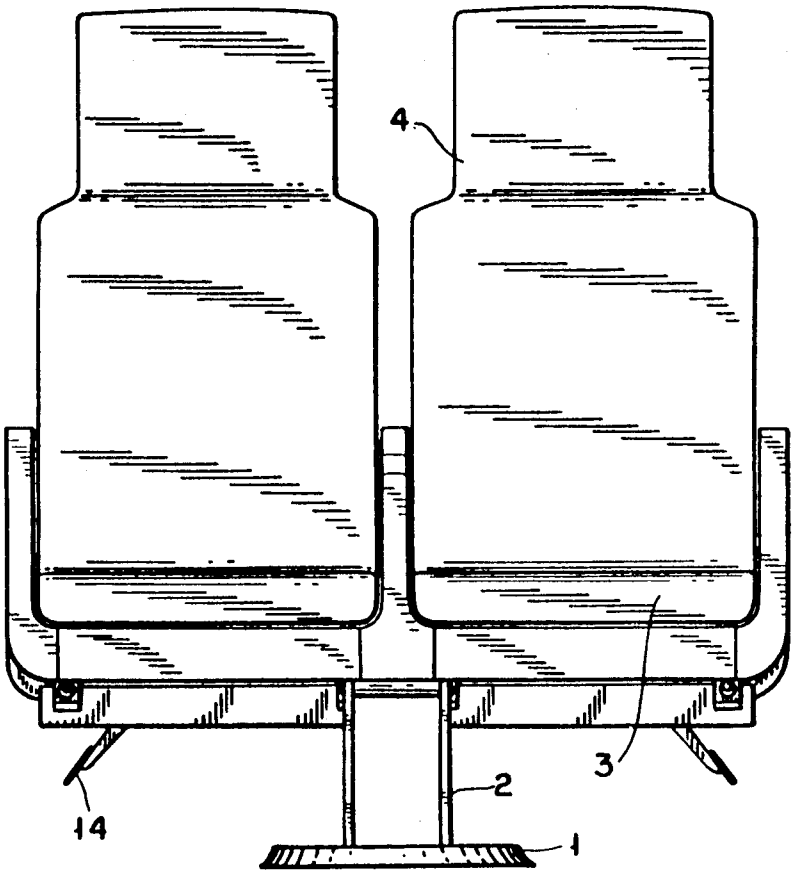

FIG. 1 is disclosing a principle side view of a chair according to the invention with the back in upright position, FIG. 2 discloses the chair in FIG. 1 in backwards tilted position, FIG. 3 discloses the chair in FIG. 1 with the position of FIG. 2 disclosed with broken lines, FIG. 4 discloses the geometrical relation being the basis for the moving pattern of the chair, and FIG. 5 discloses a rear view of a chair having two seats and being adapted to be turned around in opposite direction.

A base body 2 installed pivotably around a vertical axis to a ground plate 1 is secured to a foundation, and being lockable in two positions 180° relatively to each other. Installed to the base body 2 is a transvers bar 15, preferably with two seats 3 and corresponding backs 4. In boths ends of the transvers bar 15 are guides 5 and 7 arranged, protruding backwards and forwards respectively. The guides 5 and 7 are arranged in an obtuse angle to each other. On the guides 5 and 7 are first and second glider 6 and 8 arranged slideably. First and second gliders 6 and 8 are connected with a forward protruding elongation of a support profile 16 arranged in the back 4 of the chair. The guides 5 and 7 and the parts connected with those are arranged in both sides of each seat 3. The distance between the pivotable connections 13 and 12 between the profile 16 of the back and the gliders 6 and 8 can be adjusted in a suitable and known way.

A roller 11 is connected with a guide 7 by a bracket 17 (not shown). The roller 11 is resting on a rail 10 being secured to the seat 3 under the front portion. The rail 10 may be plane or have a curvature. The rear portion of the seat is secured to the turning joint 13 which again is connected with the first glider 6.

When the back 4 of the chair is pressed backwards and the seat 3 by corresponding pressure from the thighs of the user, is pressed forwards, the gliders 6 and 8 are displaced on the guides 5 and 7 and the rail 10 thereby is rolling on the roller 11. Hereby is simultaneously achieved a widening of the angle between the seat 3 and the back 4 without assuming any substantial increase in their distance. When the first glider 6 is moved forwards, a gas spring 9 simultaneously is compressed, being connected with the connection joint 13 and a front portion of the not disclosed frame of the chair. The gas pressure spring will dampen the movement of the seat and the back and simultaneously press the chair back to upright position by releasing a suitable releasing device.

By activation of a pedal 14 arranged at both sides the chair, the releasing device for the gas pressure spring also is activated in such a way that the back of the chair is erected and at the same time the locking between the base body 2 and the ground plate 1 is released and the chair can be turned to in opposite direction.

FIG. 4 discloses schematically the geometric dimensions determining the movements of the back 4 and the seat 3 as well as the relative movements of these. The distance c between the journals 13 and 12 may be adjusted, whereas the distance a between the journal 13 and the roller 11 is fixed by the bracket 17, and so is the distance b between the same. Correspondingly also the obtuse angle d between the guides 5 and 7 is fixed, and so also the angular arrangement of the guides in relation to the foundation, e.g. the angle e.

The rail 10 may be plane as disclosed in FIG. 1-3, or having a curved shape, such as arcuate as disclosed in FIG. 4, to be able to control the movement of the front portion of the seat 3 as desired. The dimentions for a-e as well as the curvature of the rail 10 are the parameters for the movements of the seat and the back in relation to the foundation where the user has his feet, as well as for their relative movements.

As disclosed in FIG. 3 it is achieved with the invention that the relative movement between the seat 3 and the back 4 substantially will be an angular movement in such a way that the user maintains his contact between his back and the chair back and his thighs and the seat respectively. Additionally is achieved that the lower portion of the back 4 is moved forwards in such a way that the user of a chair situated behind the described chair, such as is usual in an apartment of a rail way compartment, will not be limited in his movements of his knees if the user of the front chair should lean the back backwards.

We claim:

1. Adjustable chair, CHARACTERIZED IN the seat of the chair comprising on each side a rail (10) secured to a front portion under the seat (3) and resting on a roller (11) connected with the chair frame, the seat being, in the rear portion on each side, connected pivotably with a guide (5) secured to the frame where the guide having slideably arranged a first glider (6), the back (4) comprising a downwards and forwards directed prolongation and being pivotably connected with the first slider (6), the front end of the prolongation being pivotably connected with a second glider (8) being slideably arranged on a second guide (7), the second guide thereby being connected with the frame, and first and second guides (5, 7) being arranged in an obtuse angle in relation to each other such that the distance between the rear portion of seat and the lower portion of the back substantially is maintained whereas the angle between the seat and the back is altered when the back is moved backwards by the user in such a way that the gliders (5, 7) and the seat (3) are displaced forwards.

2. Chair according to claim 1, CHARACTERIZED IN a gas pressure spring (9) being connected between the first glider (6) and the frame, the gas pressure spring (9) thereby being tensioned when the back is displaced backwards, and a releasing device being arranged for the gas pressure spring, which device may be activated by the user in such a way that the first glider (6) is pressed backwards to a position where the back has an upright position.

3. Chair according to claim 1 or 2, CHARACTERIZED IN the releasing device for the gas pressure spring (9) being activated by pedals (14) arranged on both sides of a chair having two seats and backs arranged on a common transversal bar (15) secured to a center base body (2) which by means of a turnable bearing rests on a ground plate (1), whereby the gas pressure spring (9) for both seats are released by activation of the pedal, both chair backs (4) thereby being adjusted to upright position and the base body (2) together with the seats thereby being free to be turned around a central vertical axis.

* * * * *